US005582233A

United States Patent [19]

Noto

[11] Patent Number: 5,582,233

[45] Date of Patent: Dec. 10, 1996

[54] AIR CIRCULATION ENHANCEMENT SYSTEM

[76] Inventor: Paul V. Noto, 2421 W. Pratt Blvd., Chicago, Ill. 60645

[21] Appl. No.: 392,081

[22] Filed: Feb. 22, 1995

[51] Int. Cl.[6] ..... F25B 29/00; F23N 5/20

[52] U.S. Cl. ..... 165/247; 165/270; 236/11; 236/46 E; 236/46 R; 62/180; 62/231

[58] Field of Search ..... 165/12, 16; 236/46 R, 236/11, 46 E; 62/180, 231

[56] References Cited

U.S. PATENT DOCUMENTS

| | | | |
|---|---|---|---|
| 2,542,763 | 2/1951 | Frisk | 165/12 |
| 3,024,007 | 3/1962 | Gordon | 165/22 |
| 3,635,044 | 1/1972 | Heth | 62/157 |
| 4,136,730 | 1/1979 | Kinsey | 165/12 |
| 4,369,916 | 1/1983 | Abbey | 236/11 |
| 4,449,375 | 5/1984 | Briccetti | 62/180 |
| 4,684,060 | 8/1987 | Adams et al. | 236/11 |
| 4,773,587 | 9/1988 | Lipman | 165/12 |
| 4,838,482 | 6/1989 | Vogelzang | 165/12 |
| 4,842,044 | 6/1989 | Flanders et al. | 165/12 |
| 4,860,552 | 8/1989 | Beckey | 62/180 |
| 4,941,325 | 7/1990 | Nuding | 62/158 |
| 5,020,332 | 6/1991 | Nakatsuno et al. | 236/46 R |
| 5,142,880 | 9/1992 | Bellis | 62/158 |

*Primary Examiner*—John K. Ford

*Attorney, Agent, or Firm*—Michael G. Berkman

[57] ABSTRACT

In a forced air heating and cooling system including a blower fan for circulating air in an air ambient use-space, a timer circuit and a power output control circuit for augmenting control and for regulating operation of the blower fan. The timer and associated circuitry functions to activate the blower fan for finite limited periods of operation at each end of each heating and cooling cycle and at time-spaced intervals when neither heating nor cooling is called for in the controlled use-space. The timer device and supporting control circuitry are simply and readily incorporated into the conditioning system with a minimum of physical disruption of disturbance of leads and connections. Heating and cooling efficiencies are enhanced, comfort level is elevated, and objectionable temperature fluctuations are smoothed.

11 Claims, 3 Drawing Sheets

AIR CIRCULATION ENHANCEMENT SYSTEM

FIELD AND BACKGROUND OF THE INVENTION

The present invention relates to a forced air heating and cooling system for conditioning a defined finite use-space to be controlled, More particularly, the invention is directed to a heating and cooling system in which auxiliary apparatus is provided and the blower fan is programmed to operate for finite, limited time periods including at time-spaced intervals when neither heating nor cooling is called for in the controlled environment or use-space.

It is known in the art relating to furnaces using forced air as a heat exchange medium to maintain operation of a fan or air blower during the time the heater (or the cooler) is acting. It has also been taught in the art to start the fan operation, for the heating mode, immediately upon activation of the heater itself rather than delaying until the air in the plenum chamber of the apparatus has reached a predetermined elevated temperature. Also suggested in the literature is to delay fan turn-off and to continue operation of the fan, after the heating source has turned off, until residual heat remaining in the air-exchange chambers and walls, etc., has been effectively stripped.

While the above modifications and "refinements" to traditional forced air heating and cooling systems contribute to the saving of what would otherwise be lost energy, they do not address what is submitted to be problems existing during time periods of non-activation of the force air heating and cooling system. During such periods, when the air conditioning heater or cooler is inactive, and the fan blower is off, the air in the "controlled" environment or use-space is not effectively circulated. The ambient air tends to stratify. Pockets develop. Stagnation occurs. Heating and/or cooling is seriously impaired. Comfort levels are significantly reduced. Energy is wasted. Such undesired and objectionable conditions persist until such time as the thermostat (wherever located) senses a pre-set limit and initiates reactivation of the heating or cooling apparatus, including the blower fan.

It is, accordingly, a principal aim of the present invention to obviate such and other short-comings and deficiencies in prior art forced air heating and cooling systems by providing a simple yet highly effective method for controlling and conditioning the ambient use-space at all times rather than only during activation of the heating or the cooling apparatus, including a short time span after the heater or cooler is turned off.

SUMMARY OF THE INVENTION

The present invention provides a timer circuit in combination with a power output circuit and related circuitry for regulating operation of the air blower fan in a forced air heating and/or cooling system.

It is an important feature of the invention that the efficiency of the system is improved, temperature and humidity are more effectively controlled, and the affected use-space or controlled area is made more comfortable.

A related advantage of the improvement of the invention is that the achieved, cleaner ambient air results in energy savings as well as in reduced wear and tear on the system components. Maintenance requirements are reduced.

An exceedingly important practical feature of the invention is that the many benefits are realized by the changing of only a single wire connection in existing systems. All other connections are made in parallel, without any disruption of the original connections. More specifically, in accordance with the present invention, the fan relay "FR" terminal of the device introduced is connected to the fan relay. The "G" terminal from the thermostat (Fan Control Terminal) is then connected to the device instead of to the fan relay (See drawings).

It is a feature of the invention that the improvement effected (and the device introduced) is inherently "fail-safe". This important benefit derives from the manner in which the device is constructed and connected in the controlled environmental system.

A related feature of the invention is that, in the unlikely event of total failure of the device and/or associated circuitry, the heating system will still operate as originally intended.

An advantage of the device is that it is of solid state elements operating at low voltages (e.g., about 24 volts). and functions safely and effectively over a wide range of voltages and temperatures. The improvement which constitutes the present invention is exceedingly safe and reliable, meeting all formal requirements.

Yet other features of the invention are its simplicity and its ease of installation. It can be retrofit in regular existing forced air heating/cooling systems in either homes, offices, or factories. It may be readily incorporated as OEM installations in new construction.

It is an operational feature of the invention that when the heating or cooling system is on, but static (no heating or cooling is being called for by the thermostat in the controlled area of use-space), the device of the invention will activate the blower for a short time (approximately 1½ minutes) and cycle on again at approximately 15 minute intervals—a duty cycle of 1:10.

It is a feature of the invention that in "heat only" systems, there may be a need for the customary fan relay.

Advantages derived through use of the present invention include the following:

Stratification of air is eliminated, so that there is effective mixing of warmer and cooler air masses tending to form at different levels, whether in single or multi-floor structures.

Effect air distribution and movement; overcome inefficiency and related problems associated with poor thermostat location.

Humidity states are more uniform, and humidifiers operate more effectively. The same benefits attach to dehumidifiers.

Air filters are able to function more effectively and more efficiently.

Air exchangers (indoor/outdoor) operate more effectively to reduce and remove indoor air pollutants.

Obviate any need to operate a blower fan continuously, thus effecting significant cost savings in energy and in maintenance.

It is a feature of the present invention that, when the system is operating in the cooling mode, and the compressor turns off, the blower fan remains on for an additional time period of, for example 2–2½ minutes so that maximum cooling energy is recovered from the air conditioning (cooling) system.

A related feature of the invention is that the system then adopts a 1:10 duty cycle in which the blower fan is on about 1½ minutes and then off about 15 minutes, and so continues until the thermostat calls for more cooling.

It is a feature of the improvement of the present invention that the blower fan is turned on immediately when heat is demanded by the system. Accordingly, heat normally lost up the flue, while the plenum is heated to a predetermined temperature, is effectively saved and put to use.

A related feature of the invention, as it operates in the heating mode, is that the blower fan remains operating for an additional period of about 2–2½ minutes after heat is no longer called for. Heat remaining in the exchange chamber and associated apparatus is recovered for use in the controlled area. Such extended operation is also provided after the limit switch in the system has turned to an "off" position. Thereafter, the system goes into a 1:10 duty cycle mode, with the blower on for about 1½ minutes and off for about 15 minutes, and so continuing.

Yet another feature of the invention is that any connections not used in a particular system or installation may be ignored because the device will function effectively in heat only, as well as in air-conditioning-only systems.

Other and further aims, features and advantages of the invention will be evident from the following detailed description considered in conjunction with the drawings.

BRIEF DESCRIPTION OF THE DRAWINGS

FIG. 4 is a block diagram indicating yet another mode of blower fan operation, in which the blower fan is cycled on and off independently of whether heating or cooling is being called for.

DETAILED DESCRIPTION OF ILLUSTRATED EMBODIMENT

In accordance with the present invention, the aims and objects are achieved by providing in a forced air heating and in a cooling system a timer device and associated circuitry for controlling and dictating the operation of a blower fan. The improvement which constitutes the present invention is characterized in that it increases the efficiency of the system by as much as 5–30%. At the same time, the controlled area or use-space is rendered more comfortable, maintenance requirements are reduced, and the life of the system is extended.

Figure 2:
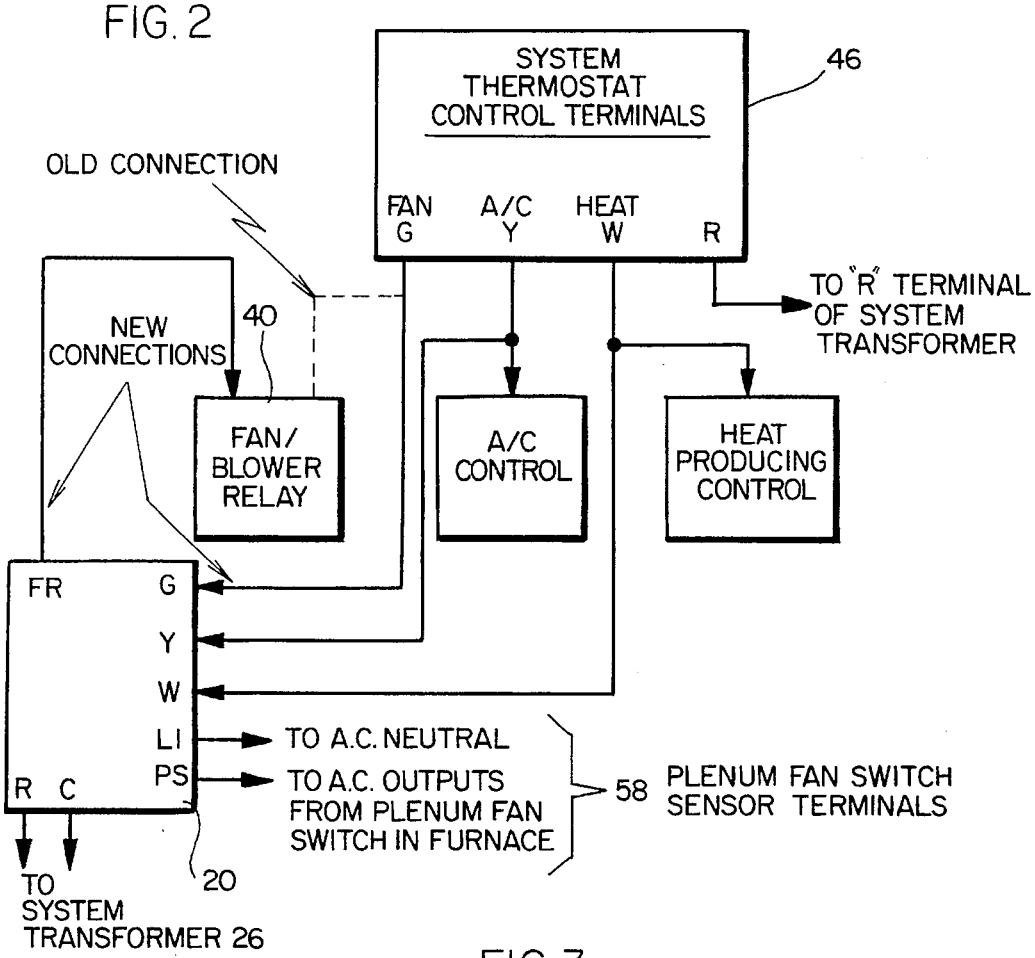
FIG. 2 is a diagram indicating schematically the electrical connections between the thermostat and various components of a forced air heating and cooling system including a heat source, cooling source, blower fan and a timer device and related controls, in accordance with the present invention.
Figure 3:
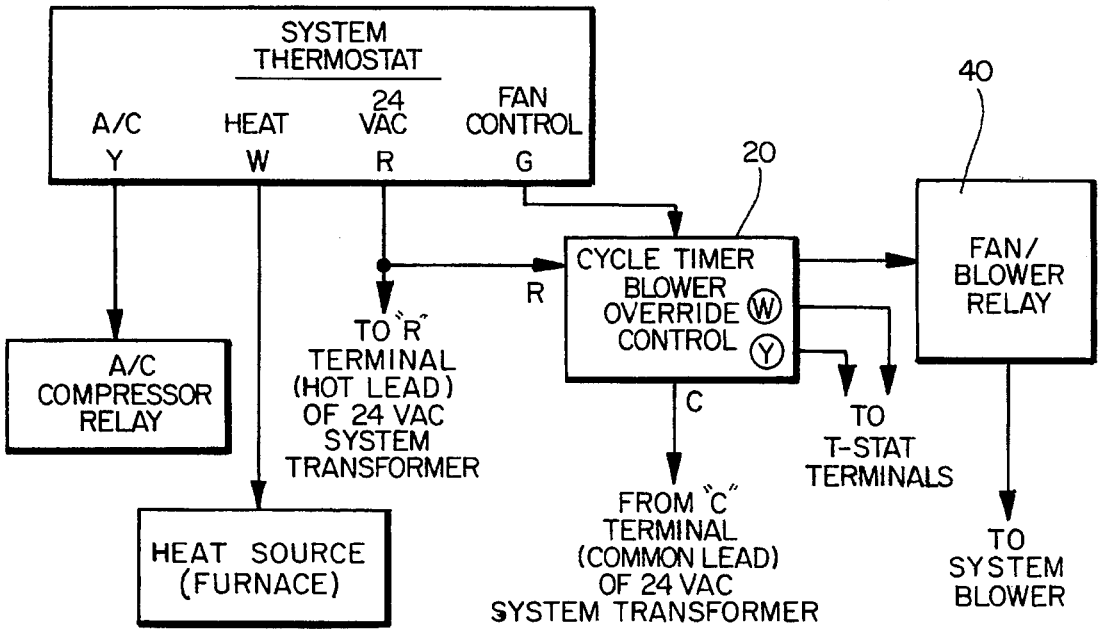
FIG. 3 is a block diagram indicating schematically a variation of the present invention in which operation of the blower fan is achieved without a special electrical hookup to the limit switch.
Figure 4:
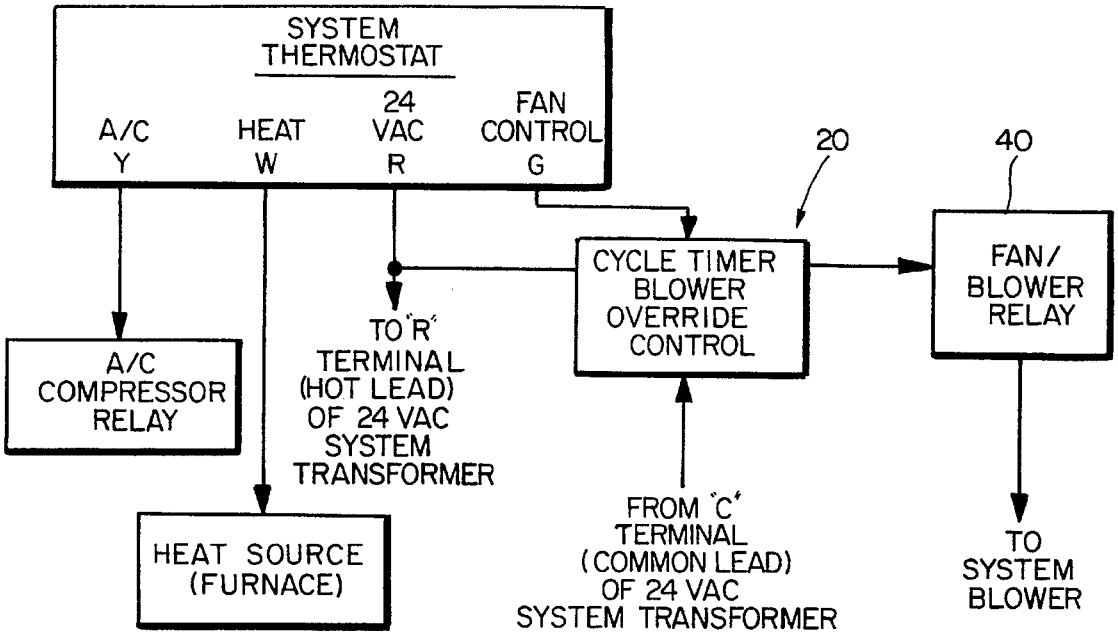
Figure 5:
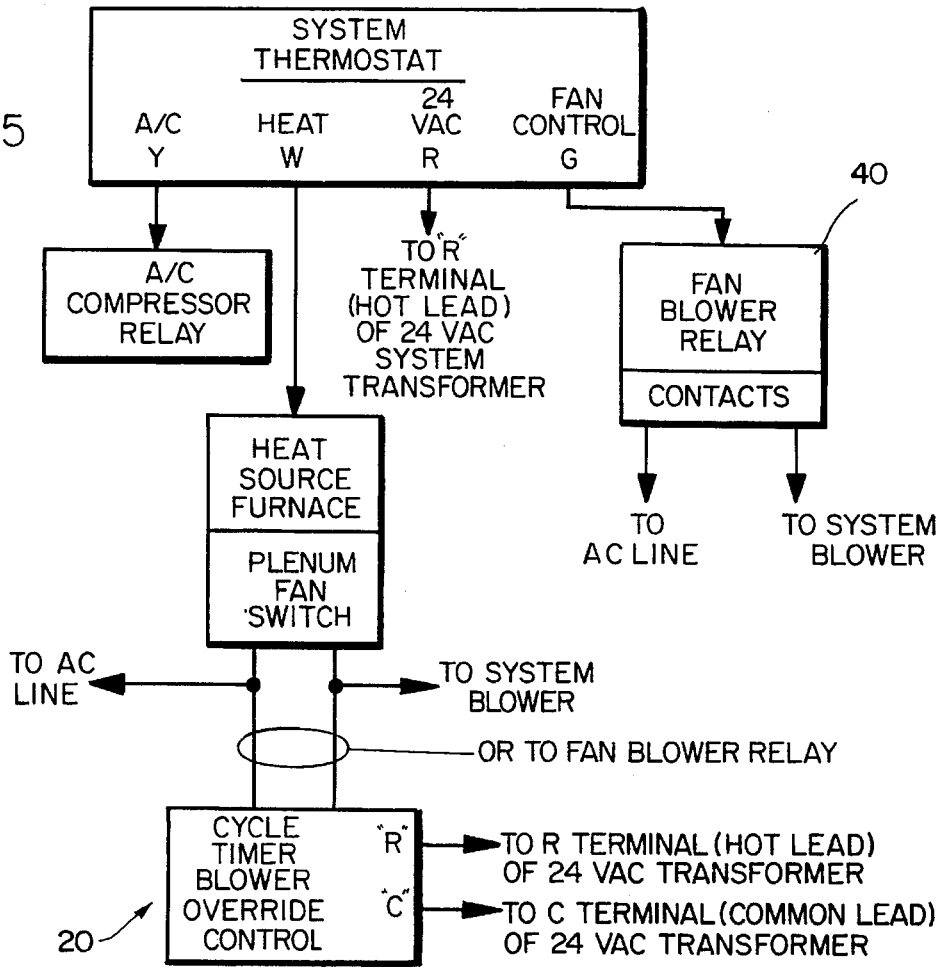
FIG. 5 is a diagram showing methods for engaging the blower fan motor directly from the A-C power supply line.

Significant is the fact that the benefits of the present invention are realized by changing only one wiring connection on the "conventional" heating and cooling system. Significantly, one need only switch the fan control wire from the fan blower relay to the timer device of the invention. The device itself constitutes an "overlay" of the system, all other connections being connected to the thermostat, in parallel (FIG. 2).

The manner in which the device of the invention is fabricated and installed renders it essentially fail-safe. Should the power output circuitry of the invention fail totally, the heating system will still function as originally intended. Should there be only partial impairment of the fan-controlling device, many of the other functions of the heating and cooling system will still be intact.

Should the output circuit stay in an "ON" position, all system functions would operate as though the thermostat fan control were left "ON".

Should the fan relay fail to be energized by the device, the heating system would still operate normally.

If the timer device were to cease operating, all other functions would continue operating normally.

The device of the invention utilizes solid state electronic components in a 24-volt system. Operation is stable over a broad temperature range (–40° C.–+85° C.). Low-stressed, solid-state semi-conductor micro circuits (U.L. approved) guarantee trouble-free, reliable operation and long life.

Figure 1:
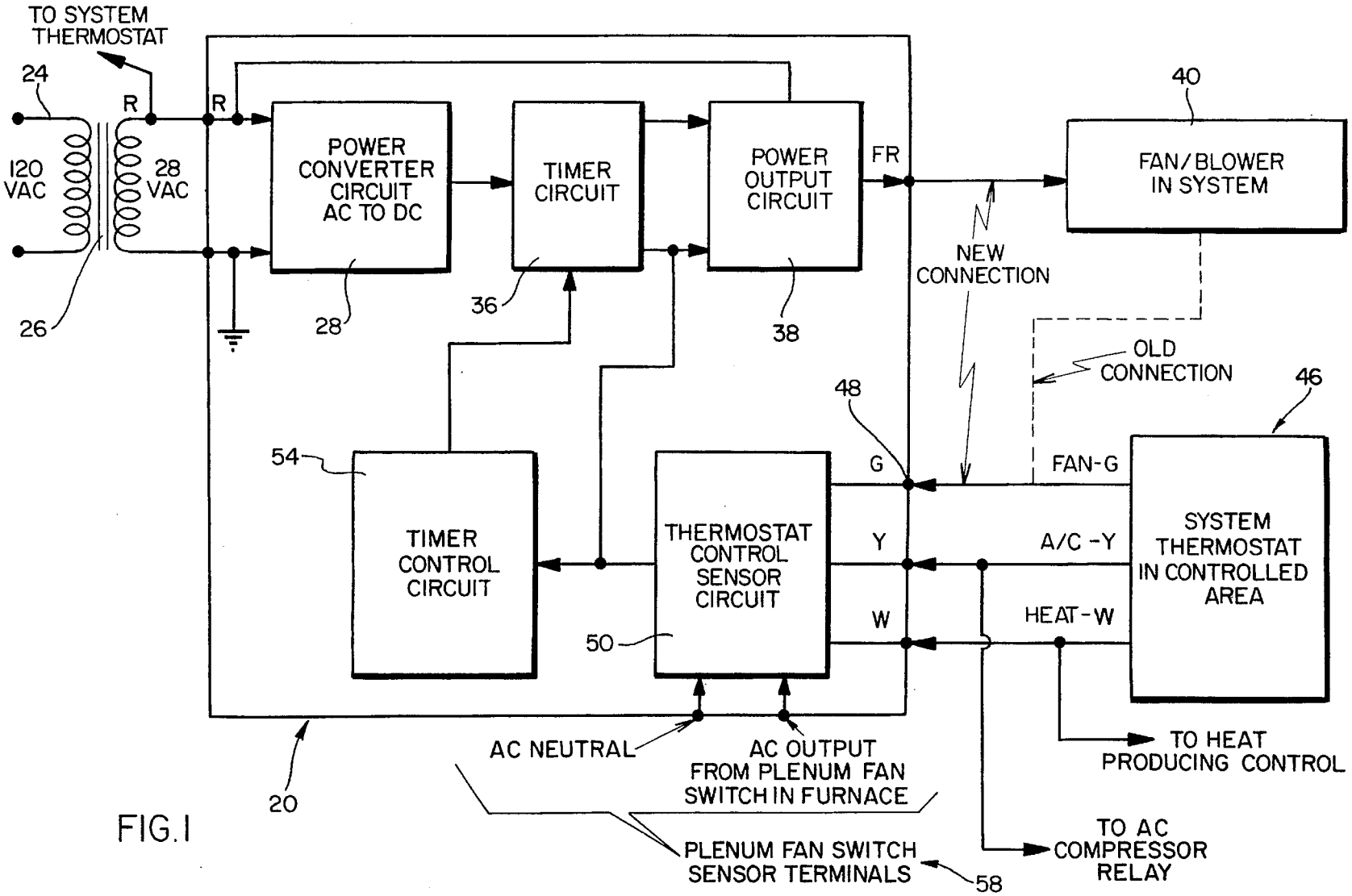
FIG. 1 is a schematic functional diagram of a timer and blower fan control system incorporating the improvement of the present invention.

Referring now more particularly to the drawing, the operation of the air circulation enhancement system 20 of the invention is described with reference to FIG. 1. When the 120 volt AC power supply 24 and an associated transformer 26 are energized, a power converter 28 of the invention connected to the AC supply 24 through the transformer 26 delivers reduced voltage (DC) to the timer device 36. The timer 36 cycles "ON" to energize the power output circuit 38 which energizes the blower fan relay 40. The power output circuit 38 is connected to and is controlled by the timer device 36, of the invention.

If the thermostat 46 is demanding heat or cooling at this time, or if the fan control 48 is "ON", the timer 36 is disabled. Nevertheless, the output circuit 38 is energized by a thermostat control sensor circuit 50.

Under conditions in which the system is static (no heating or cooling is being demanded by the system thermostat 46) the timer 36 will cycle "ON" for approximately 1½ minutes and will then turn "OFF" for approximately 15 minutes and a timing sequence and cycle of 1:10 (ON:OFF) will be initiated, that is 1½ minutes "ON" and 15 minutes "OFF".

When the system is active (Heat or cooling is being demanded, or the blower fan control 48 is "ON") the thermostat control sensor circuit 50 will turn on the power output circuit 38 to energize the fan relay 40. At the same time, the timer disabling circuit 54 will be energized to turn off and to reset the timer 36. If the system limit switch 58 (on the furnace Plenum) is "ON", the timer 36 will also be disabled and reset to "OFF".

When the system thermostat 46 is satisfied, and no longer calls for heat or cooling, and the system limit switch 58 is "OFF", the timer circuit 36 will turn "ON" and keep the power output circuit 38 energized for 2–2½ minutes before resuming the 1:10 duty cycle of "ON": "OFF". At such time the only component turning on and controlling the power circuit 38 is the timer 36.

It will be appreciated that the specific example of the invention described above is a preferred embodiment only. In the light of the teachings of the present invention structural elements and features may be varied and/or modified without effecting a significant change and without divergence from the present invention as defined in the appended claims. Designation of time durations such as in the ON-OFF sequences is not critical. For example, the blower fan may be energized for about ½ to about 5 minutes and the stand-by or "inoperative" period may be 5 to 30 minutes. Nor is the time ratio of 1–10 for operation and for standby of the blower fan critical. Election of specific ratios are within the skill of those skilled in the art, and do not rise to the level of invention. All such variations are believed to fall within the scope of the appended claims.

A direct benefit realized through the practice of the present invention is that the controlled use-space is made more comfortable. The enhanced comfort is realized even though the actual temperature is at a fuel and energy-conserving setting of the control thermostat. For example, the setting may be at 72° F. rather than at 75° F. during heating demand periods, and may be at 75° F. rather than 72° F. during the cooling season. The present invention obviates any need for users to overcompensate in their settings. The discomfort often experienced as a result of temperature fluctuations is avoided.

While the comfort benefits achieved through practice of the present invention may also be realized by permitting the blower fan to run continuously, such an alternative procedure is wasteful of energy, and is costly. Operation of the fan in accordance with the present invention effects savings of about 90% of the expense which would be incurred should the blower fan be allowed to operate continuously. Additionally, the life of the blower motor and associated electrical and mechanical components would be extended, significantly.

Alternative techniques for achieving the goals of the present invention lie within the scope of the inventive concept herein set forth. One such variation is to provide a cycle control timer for actuating the blower fan as an override operation independently of the fan control circuitry found in the conventional heating/cooling system. Air in the controlled use-space will be circulated by the fan at selectively-spaced time intervals for selectable limited time durations. Regular operation of the heating/cooling system would not be adversely affected or interfered with.

As a variation of this technique, the over-ride blower fan control could be programmed to be engaged and to operate only when neither heating nor cooling was being called for. The result would be a mode of blower fan operation closely resembling that established in embodiments of the invention previously described.

The mechanics for effectuating the over-riding mode of blower fan operation include several options. One technique—preferred because it requires no direct line connection—is to hook the fan up to a relay and use a 24-V AC supply to energize the system. No limit switch sensing would be involved in such an arrangement.

An alternative method is to use the available line voltage to connect across the contacts of the limit switch, or across the fan relay contacts. Such an arrangement is equivalent to connecting the AC power line directly to the blower motor.

Should a two-speed blower motor be used in the system, connection should be made to the limit switch.

What is claimed is:

1. In the operation of an energy-conversing, forced-air, heating and air-cooling, temperature-conditioning, controlled system including a heater, a cooler including a compressor, heat-exchange apparatus, including an air-circulating blower fan for circulating air in said system, sensor means which also includes thermostat means responsive to sensed selectable temperature settings for activating, selectively, said heater and said cooler, and fan relay means for energizing said fan for circulating air in defined ambient use-space served and conditioned by said system, and including the steps of automatically performing operational steps during heating and cooling cycles of said system for enhancing heating and cooling efficiency, for raising comfort level, and for smoothing temperature fluctuations in a finite said ambient use-space, the improvement comprising coupling a timer device into said system, including the step of disconnecting a wire lead from said fan relay means and reconnecting the wire lead to a fan control terminal of said device at a locale remote from said thermostat means, making wire connections to leads from said thermostat means in a zone remote therefrom at heating and conditioning controls of said system, making said connections in parallel with pre-existing connections at the heating and cooling controls of said system remote from and without disruption of connections at said thermostat means, automatically and continuously controlling operation of said system, including in heating-only systems, in cooling-only systems, and in systems providing both heating and cooling, programming said timer device to delay cessation of blower fan operation and to maintain said blower fan in operation for a limited finite time period after said cooler ceases operation, and also after said heating ceases operation, effecting functional connection between said timer device and said blower fan for controlling operation of said blower fan during time periods in which neither heating nor cooling is called for in said use-space, and programming said timer device to energize said blower fan for limited time periods of selectable duration and selectable frequency for establishing time-spaced intervals of forced air circulation during non-operational periods of heating and of cooling modes of said system, and without disrupting normal operation of heating and cooling cycles of said system.

2. The improvement as set forth in claim 1 and wherein with said system operating in a cooling mode, but with no cooling being called for, said timer device effects energization of said blower fan at intermittent time intervals of 5–30 minutes and for short time durations of ½ to 5 minutes each.

3. The improvement as set forth in claim 1 and wherein with said system operating in a heating mode, but with no heating being called for, said timer device functions to energize said blower fan at intermittent time intervals of 5 to 30 minutes and for short time durations of ½ to 5 minutes each.

4. The improvement as set forth in claim 1 and wherein with said system operating in a cooling mode but with cooling demand satisfied, said timer device functions to energize said blower fan for an additional 1–5 minutes after said cooler is turned off.

5. The improvement as set forth in claim 11 and wherein with said system being in an operating mode, but with no heating and with no cooling being called for, said timer device functions to energize said blower fan and to render said blower fan inoperative in a time-span ratio of 1 operative to 10 inoperative.

6. The improvement as set forth in claim 5 wherein said timer device functions to energize said blower fan for 1½ minutes and to deactivate said blower fan for 15 minutes, in a repeating sequence.

7. The improvement as set forth in claim 1 and wherein with said system operating in a heating mode but with heating demand satisfied, said timer device functions to energize said blower fan for an additional 1–5 minutes after said heater is turned off.

8. The improvement as set forth in claim 1 and further comprising means for programming said timer device for ensuring energization of said blower fan promptly when heating is called for in said system.

9. The improvement as set forth in claim 1, and characterized in that in the event of failure of energization of said fan relay means, operation of said heater in said system continues normally, and further characterized in that in the event of cessation of operation of the timer device, all other operational functions continue normally.

10. The improvement as set forth in claim 1 including the step of maintaining said fan in an operating mode for a finite period after a plenum fan control switch in said system assumes an "OFF" position, thereby effecting useful recovery of heat energy remaining in a heat exchange chamber and associated apparatus of said system.

11. The improvement as set forth in claim 1 including the step of energizing said fan under conditions in which said heat source turns off before air in the plenum has reached a temperature at which said fan is normally energized.

* * * * *